United States Patent [19]

Angott et al.

[11] Patent Number: 4,538,973

[45] Date of Patent: Sep. 3, 1985

[54] REMOTELY CONTROLLED CEILING FAN AND LIGHT CIRCUIT

[76] Inventors: Paul G. Angott, 457 Hurst, Troy, Mich. 48098; Keith D. Jacob, 2321 S. Circle Dr., Ann Arbor, Mich. 48103

[21] Appl. No.: 604,153

[22] Filed: Apr. 26, 1984

[51] Int. Cl.[3] ..... F04B 21/00

[52] U.S. Cl. ..... 417/572; 174/54; 340/696; 340/825.69; 340/825.72; 361/399; 362/96; 416/5; 416/170 R

[58] Field of Search ..... 174/54, 61; 340/696, 340/825.69, 825.72; 362/96; 361/395, 399, 384, 377; 416/5, 170 R; 98/40 D, 40 DL; 417/572, 410

[56] References Cited

U.S. PATENT DOCUMENTS 3,689,927 9/1972 Boston ..... 340/825.72

4,064,427 12/1977 Hansen et al. ..... 417/424 X 4,371,814 2/1983 Hannas ..... 318/345 D 4,402,649 9/1983 Laurel ..... 416/5

4,465,956 8/1984 Fowler ..... 318/336 X

*Primary Examiner*—Edward K. Look

*Attorney, Agent, or Firm*—Reising, Ethington, Barnard, Perry & Milton

[57] ABSTRACT

A ceiling mounted fan and light assembly remotely controlled by radio signals propagated by a remote transmitter with the transmitter having independent controls for the fan and light respectively. The receiver has two channels and is responsive to the signals for setting the power supplied to the fan drive motor and light respectively at different levels so that the rotational speed of the fan may be set at various different levels and the illumination of the light may be set at various different levels.

21 Claims, 10 Drawing Figures

REMOTELY CONTROLLED CEILING FAN AND LIGHT CIRCUIT

TECHNICAL FIELD

The subject invention relates to an air-circulating fan assembly suspended from a ceiling including a rotating fan and a light.

BACKGROUND OF THE INVENTION

Ceiling mounted fans are usually controlled by a wall mounted switch or a pull chain hanging from the fan assembly. Such controls are frequently difficult and expensive to instal and function only to turn on and off power to the fan assemblies.

SUMMARY OF THE INVENTION

A fan assembly for being mounted to a ceiling and suspension therefrom including: support means adapted for connection to a ceiling; a fan blade means rotatably supported by the support means; an electrical drive motor supported by the support means for rotating the fan blade means; an electrical light means supported by the support means for selectively providing illumination; and receiver means electrically connected respectively to the drive motor and the light means and adapted for electrical connection to the electrical power outlet for controlling the electrical power supply to the drive motor and the light means independently of one another in response to predetermined first and second radio signals. The receiver means includes electrical current regulator means for establishing the magnitude of electrical power supplied to the drive motor and the light means respectively over a predetermined range of power in response to the first and second radio signals respectively so that the employment of the first radio signal determines the speed of rotation of the drive motor for the fan blade means and the employment of the second radio signal determines the degree of illumination of the light means. The regulator means includes memory means for establishing the level of magnitude of power and for providing a predetermined reference level within the predetermined range of power supplied to the drive motor and the light means respectively, and reset means for resetting the memory means to the reference level in response to the employment of the respective radio signals. The regulator means includes power level divider means for dividing the predetermined range of power supplied to the drive motor into a first plurality of stepped power levels and for dividing the predetermined range of power supplied to the light means generator. The fan pulse generator is responsive to the second direct current signal for generating the pulse and the light digital counter is responsive to the pulses from the light pulse generator for storing and counting the pulses; and the fan digital counter is responsive to the pulses from the fan pulse generator for storing and counting the pulses.

DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
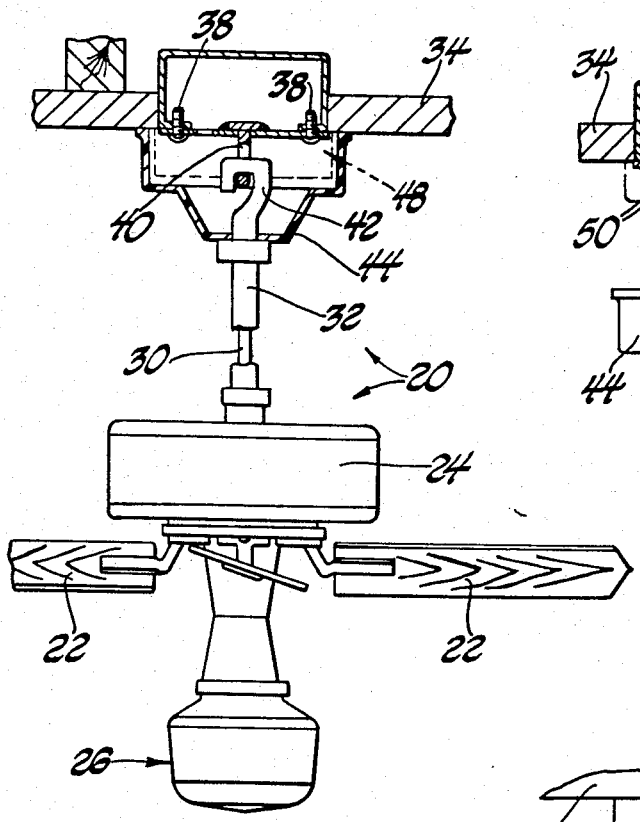
FIG. 1 is an elevational view partially broken away and in cross section of a fan and light assembly of the subject invention suspended from a ceiling.
Figure 2:
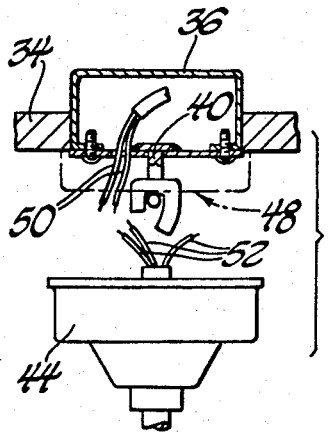
FIG. 2 is an exploded view similar to FIG. 1 illustrating the assembly of the subject invention.
Figure 3:
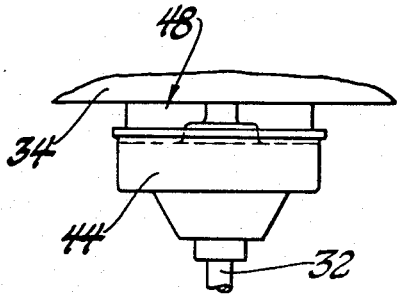
FIG. 3 is a view similar to FIG. 2 but showing the assembly complete.
Figure 4:
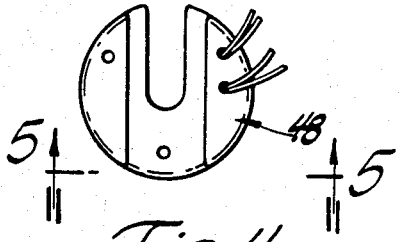
FIG. 4 is a plan view of the receiver portion of the remote control assembly.
Figure 5:
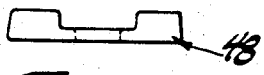
FIG. 5 is an end or side view taken substantially along line 5—5 of FIG. 4.

A fan assembly for being mounted to a ceiling and suspended therefrom is generally shown at 20 in FIG. 1.

Such ceiling mounted fan assemblies include a plurality of paddles or blades 22 extending radially from a hub which is rotated by an electrical drive motor 24. Suspended centrally of the hub is an electrical light means generally indicated at 26 for selectively providing illumination.

The assembly 20 is suspended from the ceiling by a mounting assembly generally shown at 28. A rod 30 extends from the mounting assembly 28 to support the light and fan assembly and a tubular housing 32 surrounds the rod 30 and encloses or houses electrical wires extending to the drive motor 24 and the light means 26.

A ceiling or structural member 34 forms a part of the supporting structure and has attached thereto an electrical outlet box 36. Screws or bolts 38 support a hooked member 40 which is, in turn, connected to the hooked upper end 42 of the rod 30 for suspending the assembly from the ceiling. A housing or canopy 44 decoratively encloses the attachment.

Figure 6:
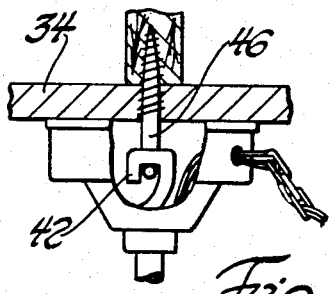
FIG. 6 is a view partially broken away illustrating an alternative arrangement for mounting a ceiling fan assembly.

Alternatively, as illustrated in FIG. 6, the supporting hook 46 may threadedly engage the support structure or ceiling 34 instead of the entire assembly being supported from an electrical box 36.

The assembly 20 includes a radio signal receiver means 48 for electrically interconnecting the power supply leads 50 and the electrical leads 52 leading respectively to the drive motor 24 and the light means 26 for controlling the electrical power supply to the drive motor 24 and to the light means 26 independently of one another in response to predetermined first and second radio signals. The radio signals may be provided by a radio transmitter assembly which is hand-held and remote from the receiver 48 and houses the transmitting circuit shown in FIG. 10.

Figure 10:
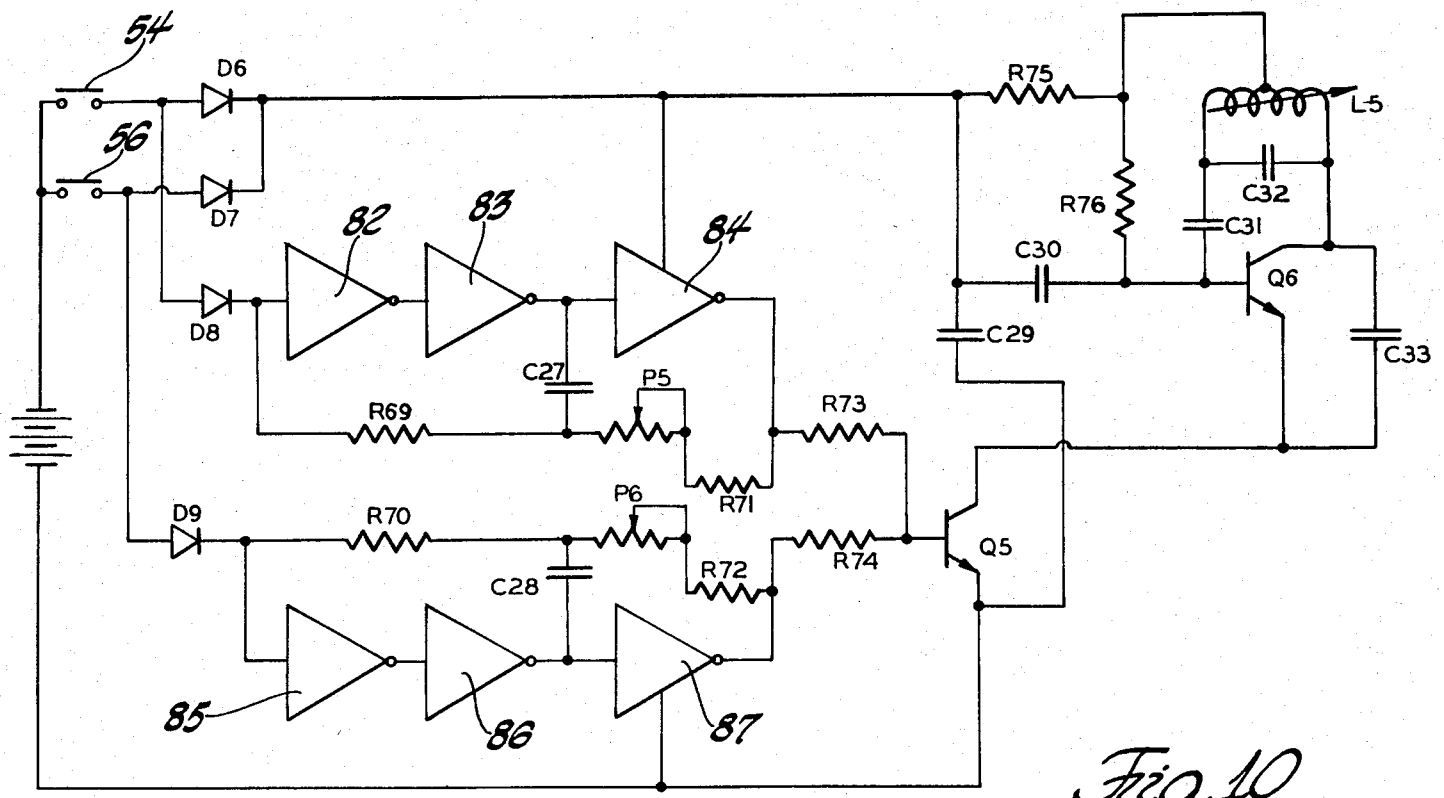
FIG. 10 is an electrical circuit schematic showing the radio signal transmitter means of the subject invention.

The transmitter means shown in FIG. 10 includes a manually actuatable fan control means comprising a manually actuatable switch 54 for transmitting a first predetermined radio signal to the receiver means 48 in response to actuation of the push button 54 for remotely controlling the electrical power supply to the drive motor 24. The transmitter means also includes a manually actuatable light control means comprising the push button 56 for transmitting a second predetermined radio signal to the receiver means 48 in response to actuation of the push button 56 for remotely controlling the electrical power supply to the light means 26.

Figure 7:
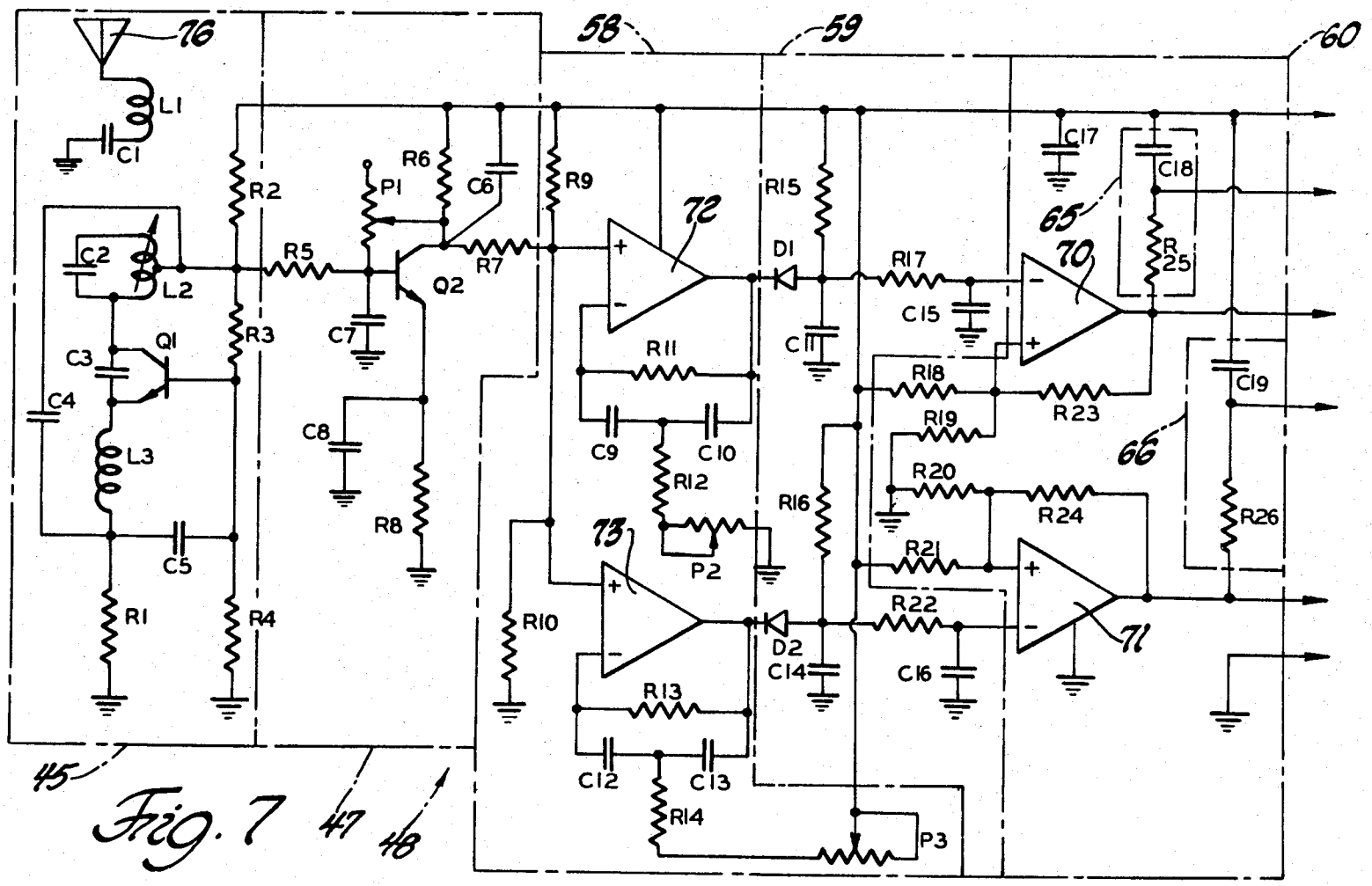
FIGS. 7, 8 and 9 are circuit schematics illustrating the radio signal receiver means of the subject invention.
Figure 8:
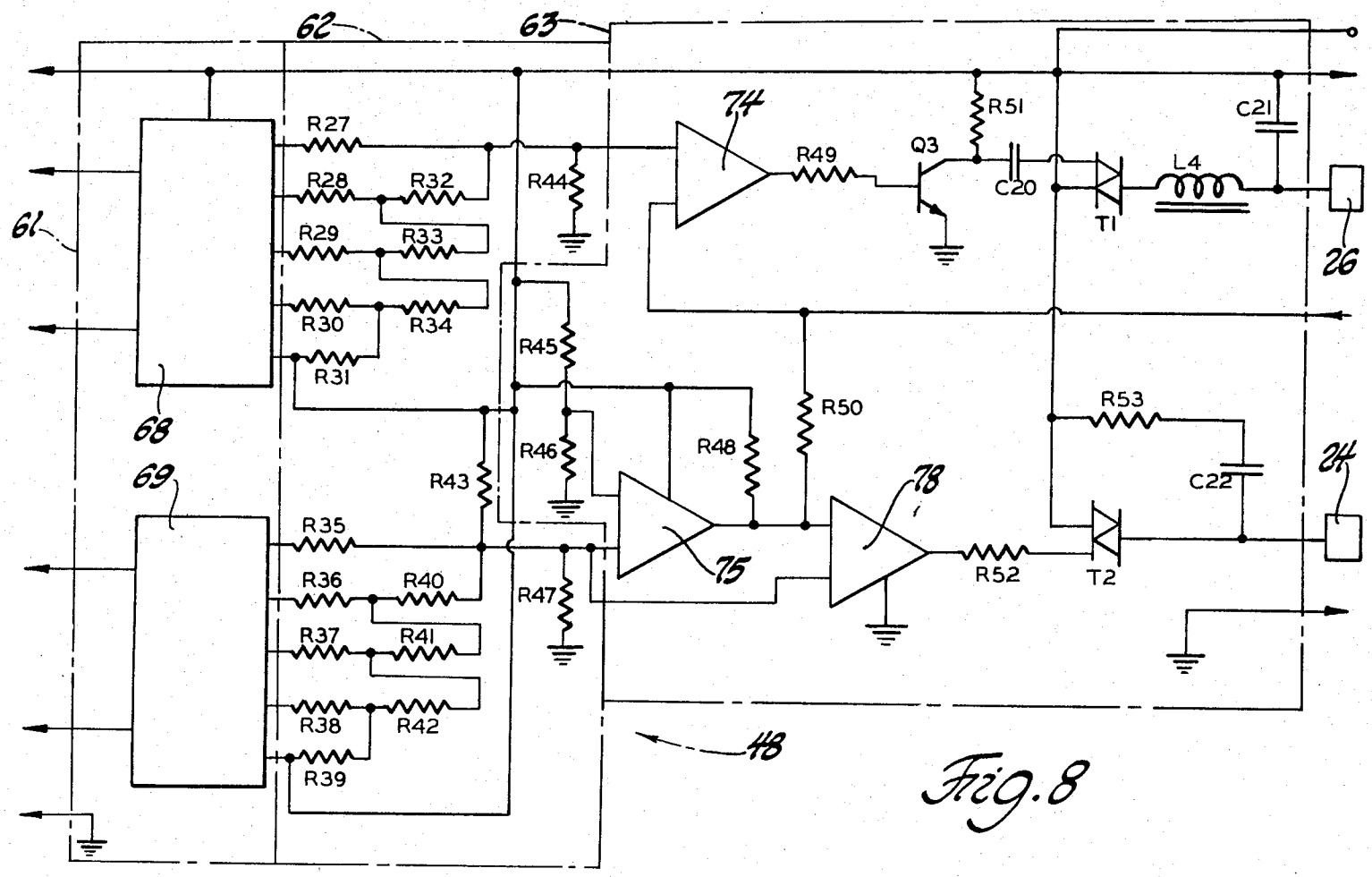
Figure 9:
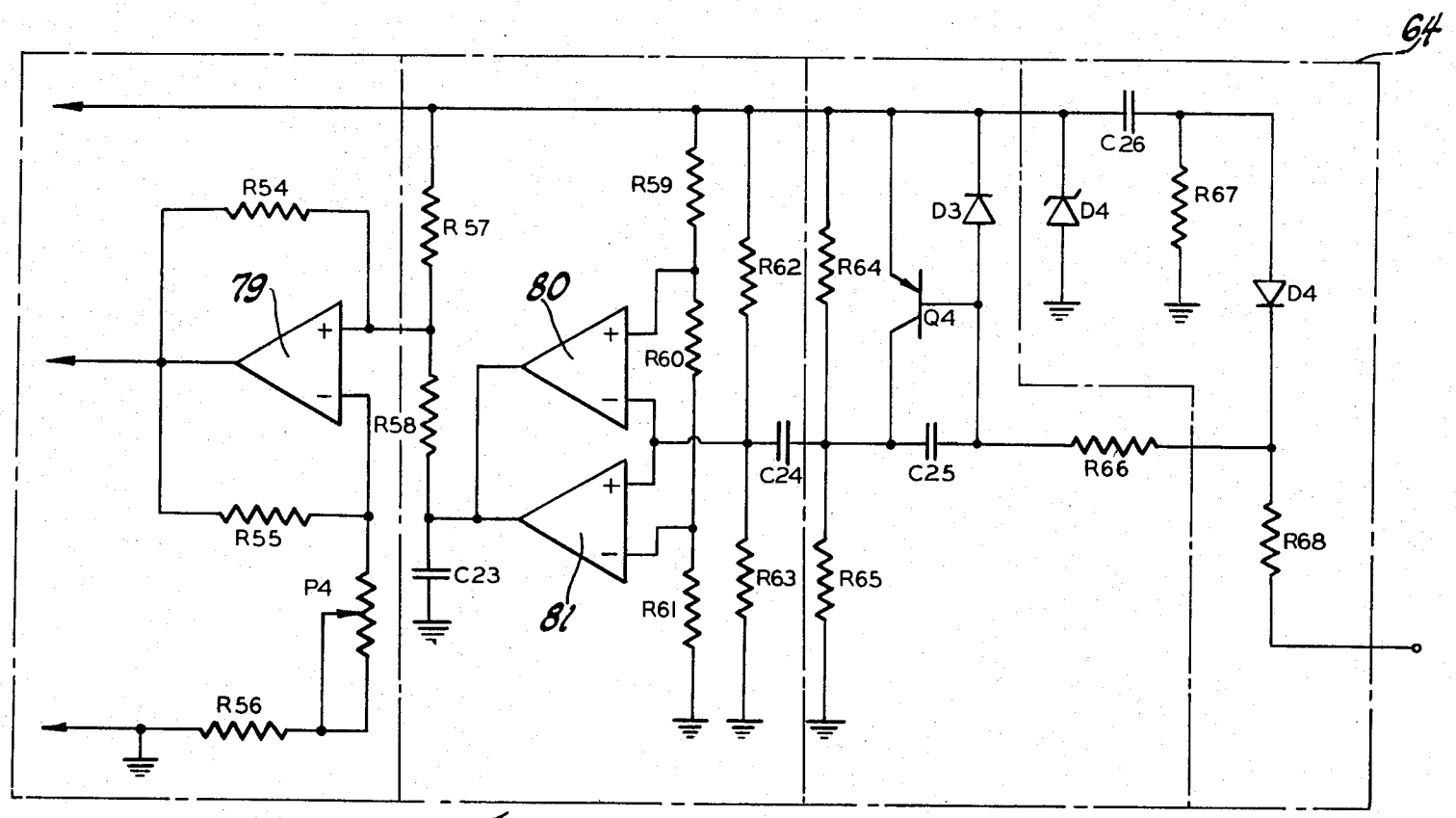

The receiver means 48, as shown schematically in FIGS. 7 through 9, includes an antenna means or stage 45, 47, a filter stage 58, 59, a pulse generator stage 60, a counter-memory stage 61, a power level divider stage 62, a differential amplifier or comparator stage 63, and a power sweep generator stage or circuit 64.

The antenna stage includes a super-regenerative detector 45 and an audio frequency amplifier 47. There are two channels defined by the circuit from the filter stage through the output, i.e., a fan channel and a light channel. The filter stage includes the audio frequency filter-/amplifier stage 58 and the detector stage 59.

The pulse generator stage 60, the memory-counter stage 61, the power level divider stage 62 and the differential amplifier stage or switching stage 63 comprise an electrical current regulator means within the receiver means 48. The regulator means establishes the magnitude of electrical power supplied to the drive motor 24 and to the light means 26 respectively over a predetermined range of power in response to the first and second radio signals respectively so that the employment of the first radio signal by the circuit determines the speed of rotation of the drive motor 24 and the employment of the second radio signal by the circuit determines the degree of illumination of the light means 26.

The memory means or stage 61 establishes the level of magnitude of electrical power and provides a predetermined reference level within the predetermined range of power supplied to the drive motor 24 and the light means 26 respectively. Also included are reset means comprising the light and fan reset circuits 65 and 66 respectively for resetting the memory means 61 to the reference level in response to the employment of the respective radio signals.

The power level divider stage 62 divides the predetermined range of power supplied to the drive motor 22 from the sweep oscillator 64 into a first plurality of step power levels and also divides the predetermined range of power supplied to the light means 26 into a second plurality of step power levels of decreasing magnitude of power from step level to step level in the predetermined range of power supplied to the light means 26 so that the degree of change of illumination from the light means between adjacent step levels usually appears substantially equal. In other words, each time the manually actuated fan push button 54 is actuated at the transmitter, radio signals are transmitted and received by the antenna stage 45, 47 and should the manual button 54 be held down for too long a period of time, say one second, as distinguished from a small fraction of a second, the reset stage 65 will cause the counter stage 61 to reset to a predetermined level, which in this case is off. The same is true of the light manually actuatable button 56 of the transmitter wherein a momentary depression of the button will cause power to be supplied to the electric light but if the button is held down too long the reset circuit 66 will reset the memory stage 61 to the off position to turn the light off. Upon initiation or actuation for a very small period of time for each of the push buttons 54, 56, a pulse will be forwarded from the pulse generation stage 60 to the memory and counter stage 61 and in response to each pulse supplied to the memory and counter stage 61, the speed of the fan motor will change an incremental amount and the power supplied or illumination of the light means 26 will change an incremental amount. For example, there may be ten levels of power supplied to the fan whereby the fan will have nine different speeds and one off position. The same is true of the light means 26 in that it may have nine degrees or degradations of illumination and one off position. However, in case of the light, it is desirable to have a proportionate amount of change in light intensity or illumination between each step or between each position each time the fan switch 56 is momentarily actuated. To accomplish this, the amount of power supplied between those different levels must be proportionately different. If there are nine different steps of illumination of the light there may be a twenty percent reduction in power supplied to the light in the first step or upon the first actuation of the push button 56 to decrease the light illumination one step whereas there may be only a ten percent further decrease in power supplied to the light in proceeding to the next step or level of power supplied to the light to obtain an equal decrease in light illumination. To accomplish this, the regulator means includes a fan channel and a light channel each responsive to radio signals received by the antenna stage 58. However, the fan channel is responsive to radio signals of a different frequency than the frequency of the radio signals to which the light stage is responsive.

The memory stage 61 includes a light digital counter 68 in the light channel and a fan digital counter 69 in the fan channel. The pulse generator stage includes a light pulse generator 70 in the light channel and a fan pulse generator 71 in the fan channel. The light pulse generator 70 is responsive to first input signals for sending pulses to the light digital counter 68 and the fan pulse generator 71 is responsive to second input signals for sending pulses to the fan digital counter 69. The light counter reset circuit 65 is in the light channel and is responsive to the light pulse generator 70 for supplying a reset signal to the light digital counter 68. Similarly, the fan counter reset circuit 66 is in the fan channel and is responsive to the fan pulse generator 71 for supplying a reset signal to the fan digital counter 69.

The light channel includes a light filter 72 for sending a signal to the light pulse generator 70 in response to the antenna stage 45, 47 receiving a radio signal of a first frequency. The fan channel includes a fan filter 73 for sensing a signal to the fan pulse generator 71 in response to the antenna stage 45, 47 receiving a radio signal of a second frequency which, as pointed out above, is different from the first frequency which actuates the light channel. The light channel circuit of the regulator means also includes a light differential amplifier or comparator 74 responsive to the light power divider circuit of the divider stage 62 and connected to the sweep generator 64 for supplying power to the light means 26 at a level which is dependent upon the input from the light power divider circuit of the divider circuit 62. The regulator means also includes a fan differential amplifier or comparator 75 in the fan channel responsive to the fan power divider circuit of the divider stage 62 and connected to the sweep generator 64 for supplying power to the drive motor 24 at a level depending upon the input from the fan power divider stage 62.

The receiver includes an antenna 76 which picks up the radio signals propagated by the transmitter shown in FIG. 10.

The super-generative detector 45 includes an antenna 76 connected to a first inductance L1 and a blocking capacitor C1. A second inductance L2 and capacitor C2 define a tuned circuit for coupling to the first inductance L1. A super-regenerative transistor Q1 is connected to the tuned circuit L2–C2 and a feedback capacitor C3 and a third inductance L3 defining an isolation choke. A coupling capacitor C4 interconnects the second inductance L2 and the third inductance L3. An emitter resistor R1 interconnects the third inductance L3 and an electrical potential, in this case ground. A capacitor C5 and resistor R4 are between the third inductance L3 and the electrical potential for setting the time constant for the quench rate for the super-regenerative transistor Q1. Biasing resistors R2 and R3 are for setting the bias on the super-regenerative transistor Q1.

The decoder means 47 is defined by an audio frequency amplifier transistor Q2 supplied a bias voltage from the detector 45 through a bias resistor R5 connected to a first quench filter capacitor C7. An emitter resistor R8 is in parallel with an emitter by-pass capacitor C8, and a collector resistor R6 is attached to the amplifier transistor Q2 and in parallel with a second quench filter capacitor C6. A variable resistor feedback P1 establishes the gain of the amplifier transistor Q2, and an output resistor R7 couples the output of the audio frequency amplifier 47 to an audio frequency amplifier filter stage 58.

The audio frequency amplifier filter stage 58 receives the output of the audio frequency amplifier 47. The amplifier/frequency stage 58 includes the light filter defined by a light signal operational amplifier 72 and the fan filter defined by a fan signal operational amplifier 73 coupled to the audio frequency amplifier 47 by light and fan biasing resistors R9 and R10 for setting the bias on the respective operational amplifiers 72 and 73. A light bridge T feedback network, including resistors, capacitors and a variable resistor R11, C9, C10, R12 and P2, is associated with the light operational amplifier 72 for establishing the response of the light operational amplifier 72 as a selective band pass filter which is tunable. A fan bridge T feedback network, including resistors, capacitors and a variable resistor R13, C12, C13, R14 and P3, is associated with the fan operational amplifier 73 for establishing the response of the fan operational amplifier 73 as a selective band pass filter which is tunable.

A detector stage 59 is responsive to the amplifier filter stage 58. The detector stage 59 includes a light detector diode D1 and associated resistors and capacitors R15, C11, R17, C15 for filtering out the audio frequency to a direct current level and a fan detector diode D2 and associated resistors and capacitors R16, C14, R22, C16 for filtering out the audio frequency to a direct current level.

The regulator means includes a pulse generator stage 60. The pulse generator stage 60 includes a light threshold detector comprising the light pulse generator 70 defined by an amplifier associated with threshold biasing resistors R18 and R19 and a positive feedback resistor R23 which provides positive feedback to establish hysteresis. The pulse generator stage 60 includes a fan threshold detector comprising the fan pulse generator 72 defined by an amplifier associated with threshold biasing resistors R20 and R21 and a positive feedback resistor R24 which provides positive feedback to establish hysteresis.

The power level divider stage 62 includes a light digital to binary analog matrix of resistors R27 through R34 and a waiting resistor R44 and a fan digital to binary analog matrix of resistors R35 through R42 and at least one waiting resistor R43, R47. The regulator means includes a power sweep generator stage 64, and a differential amplifier and comparator stage 63. The comparator stage 63 includes the light comparator 74 combined with light amplifier transistor Q3 through a resistor 49 to a first triac T1 associated with a resistor-capacitor R51–C20 for comparing the output of the light power divider circuit with the sweep generator stage 64 to turn on the amplifier transistor Q3 and activate the first triac T1. The differential amplifier and comparator stage 63 further comprises the fan comparator 75 for determining a first step from the fan power divider circuit in combination with biasing resistors R45, R46 and a second fan comparator 78 turned on by the first fan comparator 75 in combination with a resistor connected to the sweep generator stage 64 to turn on a second triac T2 through a resistor R52 whereby the second comparator 78 turns on when the input to the first fan comparator 75 equals the exponential sweep from the generator stage 64. The second triac T2 is associated with a snubber network comprising a resistor and capacitor R53, C22 to dampen transient when current goes to zero. An inductance and capacitor, L4–C21, is associated with the first triac T1 for filtering radio frequency interference. The power sweep generator stage 64 includes a power supply network, a squaring amplifier, a biphase pulse generator and a sweep generator. The power supply network includes a power resistor R68 to limit power to a Zenner diode D4 acting as a half wave rectifier to charge a capacitor C26 and a supply resistor R67. The squaring amplifier includes a squaring transistor Q4 the base of which is supplied power through a resistor R66. A diode D3 restricts reverse polarity to the input of the transistor Q4. A pair of collector resistors R64, R65 are included for the transistor Q4, and a collector-base capacitor C25 is included for transistor Q4 to suppress transients.

The biphase pulse generator includes a resistor-capacitor network R62, R63, C24 for differentiating a square wave input from the squaring amplifier and setting the bias on two comparators 80, 81 with additional resistors R59, R60, R61, setting the bias on other inputs to the comparators 80, 81 so that one of the comparators 80 fires when the differented signal is positive and the other comparator 81 fires when the differential signal is negative to combine and generate a negative output pulse. The sweep generator includes an operational amplifier 79 responsive to the output of the pulse generator and acting as an exponential sweep generator. Resistors and a variable resistor R55, R56 and P4 establish the gain of the amplifier 79 and an output resistor R54 is in the output of amplifier 79. The amplifier 79 has a gain greater than one so that the resulting rise in voltage rises exponentially until discharged by one of the comparators 80, 81 of the pulse generator.

A transmitter means, as shown in FIG. 10, is included and comprises a first switch 54 for supplying power through a first diode D6 to a radio frequency oscillator and through a second diode D8 to an inverter network 82, 83, 84 combined with resistors R69, R71, P5 and a capacitor C27 to define an audio frequency square wave oscillator the square wave of which is applied through a resistor R73 to a transistor Q5 which then supplies square wave current to a square wave oscillator transistor Q6. A second switch 56 is included for supplying power through a third diode D9 to an inverter network 85, 86, 87 combined with resistors R70, R72, P6 and a capacitor C28 to define an audio frequency square wave oscillator the square wave of which is applied through a resistor R74 to a transistor Q5 which then supplies square wave current to the square wave oscillator transistor Q6 the bias of which is controlled by biasing resistors R75, R76 and combined with a feedback capacitor C33. An inductance-capacitor network L5, C32 acts as a tuned circuit for the oscillator. Also included are a coupling capacitor C31, a battery by-pass capacitor C29 to remove audio frequency, and an antenna coupling capacitor C30.

By way of example and certainly not by way of limitation, the preferred embodiments of the circuits illustrated may include the following components.

CAPACITOR

| Capacitor | Value (farad) | Voltage |
|---|---|---|
| C-1 | 100 pico minimum | 500 |
| C-2 | 3 pico | 50 |
| C-3 | 5 pico | 50 |
| C-4 | 100 pico | 50 |
| C-5 | 560 pico | 50 |
| C-6 | 4.7 nano | 50 |
| C-7 | 4.7 nano | 50 |
| C-8 | 100 micro | 10 |
| C-9 | 2.2 nano | 50 |
| C-10 | 2.2 nano | 50 |
| C-11 | 22 nano | 50 |
| C-12 | 2.2 nano | 50 |
| C-13 | 2.2 nano | 50 |
| C-14 | 22 nano | 50 |
| C-15 | 10 nano | 50 |
| C-16 | 10 nano | 50 |
| C-17 | 100 micro | 10 |
| C-18 | 10 micro | 25 |
| C-19 | 10 micro | 25 |
| C-20 | 22 nano | 50 |
| C-21 | .1 micro | 250 |
| C-22 | .1 micro | 250 |
| C-23 | 47 nano | 50 |
| C-24 | 22 nano | 50 |
| C-25 | 4.7 nano | 50 |
| C-26 | 100 micro | 25 |
| C-27 | 4.7 nano | 50 |
| C-28 | 4.7 nano | 50 |
| C-29 | 2.2 micro | 25 |
| C-30 | 5 pico | 50 |
| C-31 | 5 pico | 50 |
| C-32 | 2 pico | 50 |
| C-33 | 3 pico | 50 |

RESISTORS

| Resistor | Value (ohms) |
|---|---|
| R-1 | 470 |
| R-2 | 8.2K |
| R-3 | 10K |
| R-4 | 3.3K |
| R-5 | 4.7K |
| R-6 | 4.7K |
| R-7 | 100K |
| R-8 | 4.7K |
| R-9 | 33K |
| R-10 | 22K |
| R-11 | 470K |
| R-12 | 1.2K |
| R-13 | 750K |
| R-14 | 2.2K |
| R-15 | 1 M |
| R-16 | 1 M |
| R-17 | 1.5 M |
| R-18 | 47K |
| R-19 | 22K |
| R-20 | 22K |
| R-21 | 47K |
| R-22 | 1.5 M |
| R-23 | 220K |
| R-24 | 220K |
| R-25 | 100K |

-continued

RESISTORS

| Resistor | Value (ohms) |
|---|---|
| R-26 | 100K |
| R-27 | 68K |
| R-28 | 68K |
| R-29 | 68K |
| R-30 | 68K |
| R-31 | 68K |
| R-32 | 33K |
| R-33 | 33K |
| R-34 | 33K |
| R-35 | 68K |
| R-36 | 68K |
| R-37 | 68K |
| R-38 | 68K |
| R-39 | 68K |
| R-40 | 33K |
| R-41 | 33K |
| R-42 | 33K |
| R-43 | 330K |
| R-44 | 47K |
| R-45 | 330K |
| R-46 | 33K |
| R-47 | 39K |
| R-48 | 2.2 M |
| R-49 | 4.7K |
| R-50 | 220K |
| R-51 | 22K |
| R-52 | 1K |
| R-53 | 1K |
| R-54 | 470K |
| R-55 | 47K |
| R-56 | 10K |
| R-57 | 10 M |
| R-58 | 68K |
| R-59 | 33K |
| R-60 | 33K |
| R-61 | 33K |
| R-62 | 33K |
| R-63 | 33K |
| R-64 | 4.7K |
| R-65 | 4.7K |
| R-66 | 39K |
| R-67 | 390 |
| R-68 | 1.5K |
| R-69 | 82K |
| R-70 | 120K |
| R-71 | 33K |
| R-72 | 47K |
| R-73 | 22K |
| R-74 | 22K |
| R-75 | 1.8K |
| R-76 | 220K |

TRIM RESISTORS

| Trim Resistor | Value |
|---|---|
| P-1 | 1 M |
| P-2 | 1K |
| P-3 | 1K |
| P-4 | 10K |
| P-5 | 20K |
| P-6 | 30K |

DIODES

| Diode | Type |
|---|---|
| D-1 | IN 4148 |
| D-2 | IN 4148 |
| D-3 | IN 4148 |
| D-4 | IN 4736A |
| D-5 | IN 4004 |
| D-6 | IN 4148 |
| D-7 | IN 4148 |
| D-8 | IN 4148 |
| D-9 | IN 4148 |

| INDUCTORS | |
|---|---|
| L-1 | 3 loops #20 wire (2.5" long) |
| L-2 | over .25 Dia. × .75 Long Velvetork Coil form with powdered slug |
| L-3 | Part of PC Board 8303 |
| L-4 | 100 microhenry RF choke 3 amp |
| L-5 | 2 loops pt. no. 099 per L1, L2 over coil form (079) with powdered iron slug (080) |

| SWITCHES | |
|---|---|
| Switch | Type |
| 54 | ALPS-KHG10901 |
| 56 | ALPS-KHG10901 |

| TRIACS | |
|---|---|
| Triac | Value |
| T-1 | 4A, 200 Volt, 25 ma gate |
| T-2 | 3A, 200 Volt, 5 ma gate |

The circuit employs various integrated circuits, many of which are the same. More specifically, integrated circuits 68 and 69 are type CD 4518BE; integrated circuits 70, 71, 72 and 73 are LM324N; integrated circuits 74 and 79 are LM358N; integrated circuits 75, 78, 80, and 81 are LM339N; and integrated circuits 82, 83, 84, 85, 86 and 87 are CD4069UBE. The transistors may be of the following types:

| | |
|---|---|
| Q-1 | NS9018F |
| Q-2 | ZN5306 |
| Q-3 | NS9013H |
| Q-4 | NS9015C |
| Q-5 | NS9014C |

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. A fan assembly (20) for being mounted to a ceiling and suspension therefrom and comprising: support means adapted for connection to a ceiling; a fan blade means (22) rotatably supported by said support means; an electrical drive motor (24) supported by said support means for rotating said fan blade means; an electrical light means (26) supported by said support means for selectively providing illumination; receiver means (48) electrically connected respectively to said drive motor (24) and said light means (26) and adapted for electrical connection to the electrical power outlet for controlling the electrical power supply to said drive motor (24) and said light means (26) independently of one another in response to predetermined first and second radio signals; said receiver means (48) including electrical current regulator means (60, 61, 62, 63) for establishing the magnitude of electrical power supplied to said drive motor (24) and said light means (26) respectively over a predetermined range of power in response to said first and second radio signals respectively so that the employment of said first radio signal determines the speed of rotation of said drive motor (24) for said fan blade means (22) and the employment of said second radio signal determines the degree of illumination of said light means (26); said regulator means including memory means (61) for establishing the level of magnitude of power and for providing a predetermined reference level within said predetermined range of power supplied to said drive motor (24) and said light means (26) respectively, and reset means (65, 66) for resetting said memory means (61) to said reference level in response to the employment of said respective radio signals; characterized by said regulator means including power level divider means (62) for dividing said predetermined range of power supplied to said drive motor (24) into a first plurality of stepped power levels and for dividing said predetermined range of power supplied to said light means (26) into a second plurality of stepped power levels of decreasing magnitude of power from stepped level to stepped level in said predetermined range of power supplied to said light means (26) so that the degree of change of illumination from said light means between adjacent stepped levels visually appears substantially equal.

2. An assembly as set forth in claim 1 further characterized by said receiver means including antenna means (45, 47) for receiving radio signals, said regulator means including a fan channel and a light channel, said memory means including a fan digital counter (68) in said fan channel and a light digital counter (69) in said light channel, said regulator means including a light pulse generator (70) in said light channel and responsive to first input signals for sending pulses to said light digital counter (68) and a fan pulse generator (71) in said fan channel and responsive to second input signals for sending pulses to said fan digital counter (69), said reset means including a light counter reset circuit (65) in said light channel and responsive to said light pulse generator (70) for supplying a reset signal to said light digital counter (68) and a fan counter reset circuit (66) in said fan channel and responsive to said fan pulse generator (71) for supplying a reset signal to said fan digital counter (69), said light channel including a light filter (72) for sending a signal to said light pulse generator (70) in response to said antenna means receiving a radio signal of a first frequency, said fan channel including a fan filter (73) for sending a signal to said fan pulse generator (71) in response to said antenna means (45, 47) receiving a radio signal of a second frequency which is different from said first frequency.

3. An assembly as set forth in claim 2 further characterized by including a sweep generator circuit (64) for supplying power to said regulator means, said power level divider means (62) including a light power divider circuit in said light channel and responsive to said light counter (68) and a fan power divider circuit in said fan channel and responsive to said fan counter (69), said regulator means including a light comparator (74) in said light channel responsive to said light power divider circuit and connected to said sweep generator circuit (64) for supplying power to said light means (26) at a level dependent upon the input from said light power divider circuit; said regulator means including a fan comparator (78) in said fan channel responsive to said fan power divider circuit and connected to said sweep generator circuit (64) for supplying power to said drive motor (24) at a level dependent upon the input from said fan power divider circuit.

4. An assembly as set forth in claim 3 further characterized by said light counter reset circuit (65) including a first capacitor (C18) for charging and sending a reset signal to said light digital counter (68) after said light filter (72) sends a signal to said light pulse generator (70) for a predetermined time interval and said fan counter reset circuit (66) including a second capacitor (C19) for charging and sending a reset signal to said fan digital counter (69) after said fan filter (73) sends a signal to said fan pulse generator (71) for a predetermined time interval.

5. An assembly as set forth in claim 4 further characterized by said transmitter being actuated to propagate a radio frequency signal including an encoded modulated audio frequency signal; said antenna means including a super-generative detector (45) for detecting said radio frequency signal received from said transmitter, and decoder means (47) for decoding and amplifying the modulated audio frequency signal; said light filter (72) being responsive to the audio frequency signal for converting same into a first direct current signal proportional to the amplitude of the audio frequency signal and sending the first direct current signal to said light pulse generator (70), said light pulse generator (72) being responsive to said first direct current signal for generating said pulse; said fan filter (73) being responsive to the audio frequency signal for converting same into a second direct current signal proportional to the amplitude of the audio frequency signal and sending the second direct current signal to said fan pulse generator (71); said fan pulse generator (71) being responsive to said second direct current signal for generating said pulse; said light digital counter (68) being responsive to said pulses from said light pulse generator (70) for storing and counting said pulses; said fan digital counter (69) being responsive to said pulses from said fan pulse generator (71) for storing and counting said pulses.

6. An assembly as set forth in claim 5 further characterized by said light power divider circuit being responsive to said light counter (68) for converting the stored digital pulses therein into an analogue voltage level supplied to said light comparator (74), said fan power divider circuit being responsive to said fan counter (69) for converting the stored digital pulses therein into an analogue voltage level supplied to said fan comparator (78).

7. An assembly as set forth in claim 6 further characterized by said receiver means including a light phase control means responsive to the output of said light comparator (74) for controlling the phase of the alternating current supplied from said light comparator (74) to said light means, and a fan phase control means responsive to the output of said fan comparator (78) amplifier for controlling the phase of the alternating current supplied from said fan comparator (78) to said drive motor.

8. An assembly as set forth in claim 7 further characterized by said super-generative detector (45) including an antenna (76) connected to a first inductance (L1) and a blocking capacitor (C1), and a second inductance (L2) and capacitor (C2) defining a tuned circuit for coupling to said first inductance (L1), a super-regenerative transistor (Q1) connected to said tuned circuit (L2–C2) and a feedback capacitor (C3) and a third inductance (L3) defining an isolation choke, and a coupling capacitor (C4) interconnecting the second inductance (L2) and the third inductance (L3), an emitter resistor (R1) interconnecting said third inductance (L3) and an electrical potential, and a capacitor (C5) and resistor (R4) between the third inductance (L3) and said electrical potential for setting the time constant for the quench rate for said super-regenerative transistor (Q1), and biasing resistors (R2, R3) for setting the bias on said super-regenerative transistor (Q1).

9. An assembly as set forth in claim 7 further characterized by said decoder means (47) being defined by an audio frequency amplifier transistor (Q2) supplied a bias voltage from said detector (45) through a bias resistor (R5) connected to a first quench filter capacitor (C7), an emitter resistor (R8) in parallel with an emitter by-pass capacitor (C8), and a collector resistor (R6) attached to said amplifier transistor (Q2) and in parallel with a second quench filter capacitor (C6), a variable resistor feedback (P1) to establish the gain of the amplifier transistor (Q2), and an output resistor (R7) for coupling the output of said audio frequency amplifier (47) to an audio frequency amplifier filter stage (58).

10. An assembly as set forth in claim 7 further characterized by including an audio frequency amplifier filter stage (58) receiving the output of said audio frequency amplifier (47), said amplifier/frequency stage (58) including said light filter defined by a light signal operational amplifier (72) and said fan filter defined by a fan signal operational amplifier (73) coupled to said audio frequency amplifier (47) by light and fan biasing resistors (R9 and R10) for setting the bias on the respective operational amplifiers (72 and 73), and a light bridge T feedback network including resistors, capacitors and a variable resistor (R11, C9, C10, R12 and P2) associated with said light operational amplifier (72) for establishing the response of the light operational amplifier (72) as a selective band pass filter which is tunable, and a fan bridge T feedback network including resistors, capacitors and a variable resistor (R13, C12, C13, R14 and P3) associated with said fan operational amplifier (73) for establishing the response of the fan operational amplifier (73) as a selective band pass filter which is tunable.

11. An assembly as set forth in claim 10 further characterized by including a detector stage (59) responsive to said amplifier filter stage (58), said detector stage (59) including a light detector diode (D1) and associated resistors and capacitors (R15, C11, R17, C15) for filtering out the audio frequency to a direct current level and a fan detector diode (D2) and associated resistors and capacitors (R16, C14, R22, C16) for filtering out the audio frequency to a direct current level.

12. An assembly as set forth in claim 7 further characterized by said regulator means including a pulse generator stage (60), said pulse generator stage (60) including a light threshold detector comprising said light pulse generator (70) defined by an amplifier associated with threshold biasing resistors (R18, R19) and a positive feedback resistor (R23) which provides positive feedback to establish hysteresis and a fan threshold detector comprising said fan pulse generator (72) defined by an amplifier associated with threshold biasing resistors (R20, R21) and a positive feedback resistor (R24) which provides positive feedback to establish hysteresis.

13. An assembly as set forth in claim 7 further characterized by said power level divider stage (62) including a light digital to binary analog matrix of resistors (R27 through R34) and a waiting resistor (R44) and a fan digital to binary analog matrix of resistors (R35 through R42) and at least one waitng resistor (R43, R47).

14. An assembly as set forth in claim 7 further characterized by said regulator means including a power sweep generator stage (64), and a differential amplifier and comparator stage (63) comprising said light comparator (74) combined with light amplifier transistor (Q3) through a resistor (49) to a first triac (T1) associated with a resistor-capacitor (R51–C20) for comparing the output of the light power divider circuit with said sweep generator stage (64) to turn on the amplifier transistor (Q3) and activate the first triac (T1), said differential amplifier and comparator stage (63) further comprising said fan comparator (75) for determining a first step from the fan power divider circuit in combination with biasing resistors (R45, R46) and a second fan comparator (78) turned on by the first fan comparator (75) in combination with a resistor connected to the sweep generator stage (64) to turn on a second triac (T2) through a resistor (R52) whereby the second comparator (78) turns on when the input to the first fan comparator (75) equals the exponential sweep from the generator stage (64), said second triac (T2) being associated with a snubber network comprising a resistor and capacitor (R53, C22) to dampen transient when current goes to zero.

15. An assembly as set forth in claim 14 further characterized by an inductance and capacitor (L4, C21) associated with said first triac (T1) for filtering radio frequency interference.

16. An assembly as set forth in claim 14 wherein said power sweep generator stage (64) includes a power supply network, a squaring amplifier, a biphase pulse generator and a sweep generator.

17. An assembly as set forth in claim 16 wherein said power supply network includes a power resistor (R68) to limit power to a Zenner diode (D4) acting as a half wave rectifier to charge a capacitor (C26) and a supply resistor (R67).

18. An assembly as set forth in claim 17 further characterized by said squaring amplifier including a squaring transistor (Q4) the hose of which is supplied power through a resistor (R66), a diode (D3) restricts reverse polarity to the input of the transistor (Q4), a pair of collector resistors (R64, R65) for the transistor (Q4), and a collector-base capacitor (C25) for transistor (Q4) to suppress transients.

19. An assembly as set forth in claim 18 further characterized by said biphase pulse generator includes a resistor-capacitor network (R62, R63, C24) for differentiating a square wave input from said squaring amplifier and setting the bias on two comparators (80, 81) with additional resistors (R59, R60, R61), setting the bias on other inputs to the comparators (80, 81) so that one of said comparators (80) fires when the differented signal is positive and the other comparator (81) fires when the differential signal is negative to combine and generate a negative output pulse.

20. An assembly as set forth in claim 19 further characterized by said sweep generator including an operational amplifier (79) responsive to the output of said pulse generator and acting as an exponential sweep generator, resistors and a variable resistor (R55, R56 and P4) for establishing the gain of the amplifier (79), an output resistor (R54) in the output of amplifier (79), said amplifier (79) having a gain greater than one so that the resulting rise in voltage rises exponentially until discharged by one of said comparators (80, 81) of said pulse generator.

21. An assembly as set forth in claim 7 further characterized by including a transmitter means (FIG. 10) comprising a first switch (54) for supplying power through a first diode (D6) to a radio frequency oscillator and through a second diode (D8) to an inverter network (82, 83, 84) combined with resistors (R69, R71, P5) and a capacitor (C27) to define an audio frequency square wave oscillator the square wave of which is applied through a resistor (R73) to a transistor (Q5) which then supplies square wave current to a square wave oscillator transistor (Q6), and a second switch (56) for supplying power through a third diode (D9) to an inverter network (85, 86, 87) combined with resistors (R70, R72, P6) and a capacitor (C28) to define an audio frequency signal wave oscillator the square wave of which is applied through a resistor (R74) to a transistor (Q5) which then supplies square wave current to said square wave oscillator transistor (Q6) the bias of which is controlled by biasing resistors (R75, R76) and combined with a feedback capacitor (C33), and an inductance-capacitor network (L5, C32) acting as a tuned circuit for the oscillator, and including a coupling capacitor (C31), a battery by-pass capacitor (C29) to remove audio frequency, and an antenna coupling capacitor (C30).

* * * * *